US009022541B2

(12) United States Patent
Hamamoto

(10) Patent No.: US 9,022,541 B2
(45) Date of Patent: May 5, 2015

(54) PRINTING APPARATUS AND INK CONTAINER

(71) Applicant: Seiko Epson Corporation, Tokyo (JP)

(72) Inventor: Seiko Hamamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,225

(22) Filed: Mar. 19, 2014

(65) Prior Publication Data

US 2014/0292965 A1 Oct. 2, 2014

(30) Foreign Application Priority Data

Mar. 27, 2013 (JP) ..... 2013-065771

(51) Int. Cl.
*B41J 2/17* (2006.01)
*B41J 2/175* (2006.01)

(52) U.S. Cl.
CPC ..... *B41J 2/1707* (2013.01); *B41J 2/1752* (2013.01)

(58) Field of Classification Search
CPC ..... B41J 2/17563; B41J 2002/14403; B41J 2/17513; B41J 2/17523; B41J 2/1631
USPC ..... 347/93, 86
See application file for complete search history.

(56) References Cited

U.S. PATENT DOCUMENTS

| | | | | |
|---|---|---|---|---|
| 6,375,308 | B1 * | 4/2002 | Shimada | 347/43 |
| 2005/0140760 | A1 * | 6/2005 | Sasaki et al. | 347/86 |
| 2010/0020140 | A1 * | 1/2010 | Yokouchi | 347/85 |
| 2011/0285798 | A1 | 11/2011 | Matsuo et al. | |
| 2012/0050423 | A1 | 3/2012 | Ishikawa | |
| 2013/0010038 | A1 * | 1/2013 | Hayakawa et al. | 347/86 |

FOREIGN PATENT DOCUMENTS

| | | |
|---|---|---|
| JP | 2011-240687 | 12/2011 |
| JP | 2012-051190 | 3/2012 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus includes an ink container tray which is capable of holding an ink container, a guide portion which guides the ink container tray in a movable manner between an ink container mounting position when mounting the ink container onto the ink container tray and an ink supply position, and a locking mechanism which, when moving the ink container tray, which is positioned further at the ink container mounting position side than a predetermined position between the ink supply position and the ink container mounting position, further to the ink supply position side than the predetermined position, stops the ink container tray from moving further to the ink supply position side than the predetermined position.

7 Claims, 10 Drawing Sheets

PRINTING APPARATUS AND INK CONTAINER

BACKGROUND

1. Technical Field

The present invention relates to a printing apparatus and an ink container.

2. Related Art

As a printing apparatus, an ink jet printer which discharges an ink from a head to form an image is known. In such a printer, the ink is supplied to the head from an ink container. In addition, there is a case where an ink (for example, a white ink) containing a settleable substance such as a pigment and the like is used in the printer. In this case, when a printing operation is not performed for a while, there is a possibility that the ink in the ink container settles.

In the related art, in order to agitate a settled ink, an agitating member for agitating the ink in the ink container is provided and the ink is agitated by driving the agitating member from outside (for example, refer to JP-A-2011-240687). Alternatively, a user removes the ink container from a printer and shakes the ink container by hand to perform agitating. In this way, the concentration of the ink in the ink container is brought into uniformity.

In the printer in JP-A-2011-240687, it is necessary to provide an agitating mechanism in the ink container. Accordingly, there is a possibility that the configuration of the device becomes complicated. In addition, when the user shakes the ink container, there is a disadvantage of being time-consuming, and furthermore in this case, the ink container is removed from the printer, so that there is a possibility of dropping the ink container by mistake during the shaking.

SUMMARY

Therefore, an advantage of some aspects of the invention is performing agitating in a simple and safe manner.

According to an aspect of the invention, there is provided a printing apparatus, including: an ink container tray which is capable of holding an ink container; a guide portion which guides the ink container tray in a movable manner between an ink container mounting position when mounting the ink container onto the ink container tray and an ink supply position; and a locking mechanism which, when moving the ink container tray, which is positioned further at the ink container mounting position side than a predetermined position between the ink supply position and the ink container mounting position, further to the ink supply position side than the predetermined position, stops the ink container tray from moving further to the ink supply position side than the predetermined position.

Other features of the invention will be apparent from the description of a specification and accompanying drawings.

BRIEF DESCRIPTION OF THE DRAWINGS

Embodiments of the invention will now be described by way of example only with reference to the accompanying drawings, wherein like numbers reference like elements.

FIG. 3A is a side view and FIG. 3B is a front view.

DESCRIPTION OF EXEMPLARY EMBODIMENTS

Outline

Figure 1:
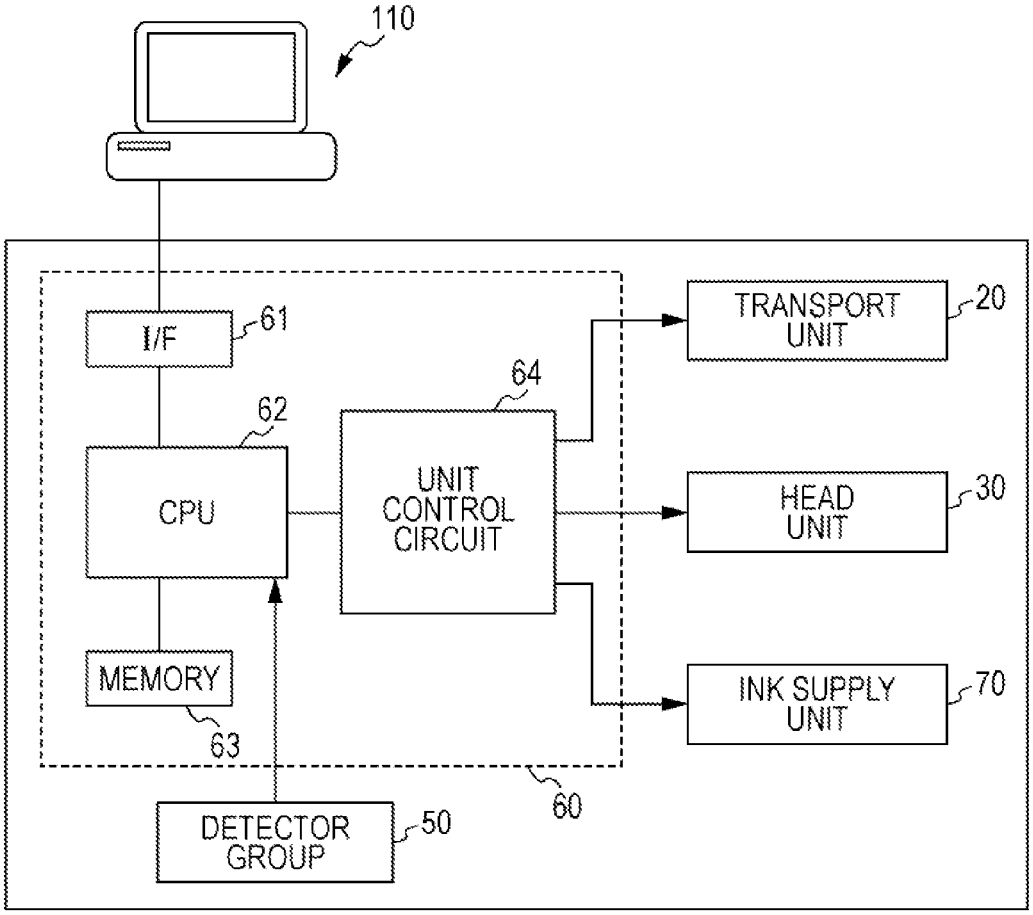
FIG. 1 is a block diagram of the entire configuration of a printer.

Description of the specification and drawings will make at least the following matters apparent.

According to an aspect of the invention, there is provided a printing apparatus, including: an ink container tray which is capable of holding an ink container; a guide portion which guides the ink container tray in a movable manner between an ink container mounting position when mounting the ink container onto the ink container tray and an ink supply position; and a locking mechanism which, when moving the ink container tray, which is positioned further at the ink container mounting position side than a predetermined position between the ink supply position and the ink container mounting position, further to the ink supply position side than the predetermined position, stops the ink container tray from moving further to the ink supply position side than the predetermined position.

In this printing apparatus, the ink container can be shaken between an ink container mounting position and an ink supply position without removing the ink container from the printing apparatus. In addition, it is possible to make the ink container tray stop at a predetermined position when shaking the ink container using a locking mechanism. Accordingly, it is possible to perform agitating in a simple and safe manner.

In the printing apparatus, it is desirable that the locking mechanism include a first locking member which is provided at the guide portion, and a second locking member which is provided at the ink container tray, and the first locking member, when the ink container tray is between the ink supply position and the predetermined position, allow the second locking member of the ink container tray to move to the ink supply position side and the ink container mounting position side, and when the ink container tray is further at the ink container mounting position side than the predetermined position, stop the second locking member of the ink container tray from moving to the ink supply position side.

In this printing apparatus, the ink container tray can be securely locked.

It is desirable that the printing apparatus include an ink supply tube, and a connection portion which connects the ink supply tube and an ink supply port of an ink pack, and when the ink container in which the ink pack is disposed is positioned at the ink supply position, the ink supply tube and the ink supply port be connected to each other through the connection portion.

In this printing apparatus, it is possible to reliably prevent damage to the connection portion due to a shake.

In the printing apparatus, it is desirable that the ink container tray be guided by the guide portion so as to have the longitudinal direction of the ink container tray and the extending direction of the guide portion matched with each other, and the ink pack be disposed in the ink container so as to have the longitudinal direction of the ink pack and the longitudinal direction of the ink container matched with each other.

In this printing apparatus, it is possible to increase the agitating amount of ink and reduce the number of shakes necessary for bringing an ink concentration into uniformity.

In the printing apparatus, it is desirable that the ink container tray have a handle and the handle protrude in a direction in which the ink container tray moves to the ink container mounting position side from the ink supply position side.

In this printing apparatus, it is possible to easily perform a shake.

In the printing apparatus, it is desirable that the ink container tray have a discharge mechanism for discharging an ink leaked from the ink container or the connection portion.

In this printing apparatus, it is possible to discharge the leaked ink to the outside or to detect an ink leakage.

It is desirable that the printing apparatus further include a first ink container holder, a second ink container holder, and a third ink container holder which each have the ink container tray, the guide portion, and the locking mechanism, and the first ink container holder and the second ink container holder be disposed side by side in a gravity direction, the first ink container holder and the third ink container holder be disposed side by side in a direction intersecting the gravity direction, the inks held in the first ink container holder and the second ink container holder be different in color, and the inks held in the first ink container holder and the third ink container holder be the same in color.

In this printing apparatus, it is easy to shake inks of the same color.

According to another aspect of the invention, there is provided the ink container which includes a first case member and a second case member, and forms a closed space in which an ink pack can be accommodated by superimposing the first case member and the second case member, and in which at least one portion of a first side surface, formed along the transverse direction of the ink container, is formed by a second side surface formed along the transverse direction of the first case member and a third side surface formed along the transverse direction of the second case member, at least one portion of a fourth side surface which is formed along the transverse direction of the ink container and opposes the first side surface, is formed by a fifth side surface formed along the transverse direction of the first case member and a sixth side surface formed along the transverse direction of the second case member, at least one of the fifth side surface and the sixth side surface has a cut-out portion where an ink supply port of the ink pack can be exposed, and the second side surface has a handle formed so as to protrude in a direction opposite from the fourth side surface.

In this ink container, it is possible to agitate an ink of the ink pack in a simple and safe manner.

In the ink container, it is desirable that the handle be provided so as to straddle the cut-out portion in the transverse direction in a plan view.

In this ink container, it is possible to easily perform a shake.

In the following embodiment, an ink jet printer (hereinafter, referred to as a printer 1) is described as an example of a liquid discharging device.

Embodiments

Configuration of Printer

Figure 2:
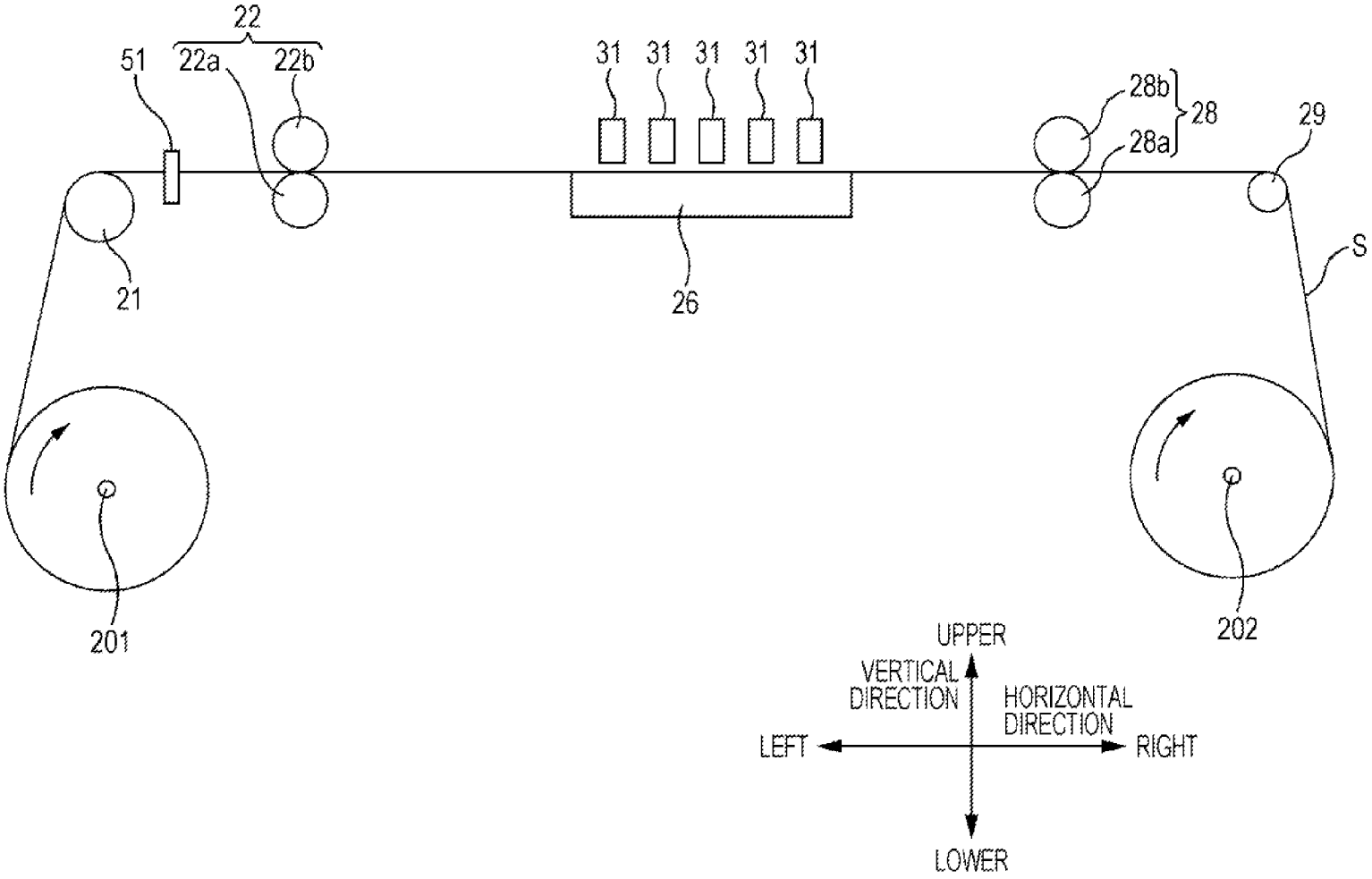
FIG. 2 is a schematic view of a transport path including a printing region.

FIG. 1 is a block diagram of the entire configuration of a printer 1. In addition, FIG. 2 is a schematic view of a transport path including a printing region.

The printer 1 is a printing apparatus which prints an image onto a medium (corresponding to a recording medium) such as a sheet of paper, cloth, film, and the like, and is connected to be able to communicate with a computer 110 which is an external device. In the embodiment, a medium on which the printer 1 records an image is described by using a sheet (hereinafter, referred to as a roll sheet S (continuous sheet)) wound in a roll shape as an example.

In the computer 110, a printer driver is installed. The printer driver is a program which is for displaying a user interface on a display unit (not illustrated) of the computer 110, and for converting image data output from an application program into printing data. The printer driver is recorded on a recording medium (a computer-readable recording medium) such as a floppy disk FD or a CD-ROM. Additionally, it is possible to download the printer driver to the computer 110 through the internet. The program is configured from a code for realizing various types of functions.

Then, the computer 110 outputs printing data corresponding to an image to be printed to the printer 1 so as to print an image by the printer 1.

The printer 1 prints an image by using inks (color ink) of four colors, cyan, magenta, yellow, and black, and a white ink for a background (ink for background).

The printer 1 includes a transport unit 20, a head unit 30, a detector group 50, a controller 60, and an ink supply unit 70. The printer 1 which receives printing data from the computer 110 which is an external device controls each unit (transport unit 20, head unit 30) using the controller 60 to print an image onto a medium according to the printing data. The controller 60 controls each unit based on the printing data received from the computer 110 to print an image onto a medium (roll sheet S). The condition in the printer 1 is monitored by the detector group 50, and the detector group 50 outputs a result of detection to the controller 60. The controller 60 controls each unit based on the result of detection output from the detector group 50.

The transport unit 20 transports the roll sheet S along the transport path set in advance. The transport unit 20, as shown in FIG. 2, includes a feed shaft 201 about which the roll sheet S is wound and rotatably supported, a relay roller 21, a first transport roller 22, a support table 26, a second transport roller 28, a tension roller 29, and a roll sheet winding drive shaft 202 which winds the roll sheet S passing through the tension roller 29.

The roll sheet S moves sequentially through each roller, thereby forming a transport path for transporting the roll sheet S.

The head unit 30 is a unit for discharging an ink to the roll sheet S. The head unit 30 has a plurality of heads 31 (corresponding to an ink discharge portion) for each ink color, and discharges an ink to the roll sheet S from each head 31, thereby forming dots on the roll sheet S and printing an image on the roll sheet S. Each head 31 of the head unit 30 of the printer 1 in the embodiment can form dots corresponding to the width of the roll sheet S at once. In addition, in the embodiment as described above, as an ink, color inks of four colors for forming an image and a white ink for a background (hereinafter, referred to as white ink) are used. As shown in FIG. 2, each head 31 is provided to be opposite to the support table 26. The configuration of the head 31 will be described in detail later.

The detector group 50 includes an edge detection sensor 51, a rotary encoder (not shown), a sheet detection sensor (not shown), and the like. The edge detection sensor 51 detects the end portion of the roll sheet S in the width direction to detect the meandering of the roll sheet S. The rotary encoder detects the amount of rotation of a first drive roller 22*a* and a second drive roller 28*a*. Based on a result of the detection of the rotary encoder, it is possible to detect a transport amount of a medium.

The controller 60 is a control unit for controlling the printer 1. The controller 60 includes an interface unit 61, a CPU 62, a memory 63, and a unit control circuit 64. The interface unit 61 transmits or receives data between the computer 110 which is an external device and the printer 1. The CPU 62 is an arithmetic processing device for controlling the entire printer. The memory 63 is for ensuring a region storing a program of the CPU 62 or an operation region, and has a memory element such as RAM, EEPROM, and the like. Moreover, the memory 63 has a register for holding control information such as flags to be described later. The CPU 62 controls each unit through the unit control circuit 64 according to a program stored in the memory 63.

An ink supply unit 70 is for supplying an ink to each head 31 of the head unit 30. The ink supply unit 70 will be described in detail later.

Configuration of Head

The printer 1 in the embodiment includes a head 31 For the four color inks (C, M, Y, K) and a head 31 for a white ink (W) which discharges a white ink for a background. Each of these heads 31 discharges an ink color for printing an image or a background.

In the embodiment, the head 31 for each color is configured to be the same. More specifically, a nozzle of each head 31 is aligned at an interval (nozzle pitch) of 600 dpi (1/600 inch) along a nozzle row direction (sheet width direction). The nozzle row direction is a direction intersecting the transport direction of the roll sheet S (the sheet width direction of the roll sheet S).

Accordingly, dots are possibly formed with a resolution of 600 dpi in the sheet width direction. In addition, the resolution in the transport direction can be adjusted by a discharge timing of an ink from a nozzle or a transport speed. In the embodiment, the dot is formed with a resolution of 600 dpi in the transport direction (a printing resolution is 600×600 dpi).

A piezoelectric element is provided corresponding to each nozzle. Then, an ink is discharged from a nozzle corresponding to the piezoelectric element based on the application of a driving signal to the piezoelectric element by the controller 60.

White Ink

The printer 1 in the embodiment uses a white ink in addition to color inks (yellow, magenta, cyan, black).

The white ink is an ink for printing a background color (white) of a color image. In this manner, a white background makes the color image easily viewable. The white ink includes a white pigment, which can settle, as a color material. The white pigment includes, for example, metal oxides, barium sulfate, calcium carbonate, and the like. The metal oxides include, for example, titanium dioxide, zinc oxide, silica, alumina, magnesium oxide, and the like. Among these, titanium dioxide is preferable from the viewpoint that this is excellent in whiteness. The white ink is a settled ink which has a property that a pigment thereof is easily settled when left alone for a long time.

Printing Operations

When the printer 1 starts printing, the roll sheet S is disposed in the transport path in a state of being supported by the support table 26 in advance. Then, a tension is provided to the roll sheet S by the output torque of the feed shaft 201, the winding drive shaft 202, and the second transport roller 28. More specifically, a predetermined tension is given to the feeding portion of the roll sheet S by the brake torque of the feed shaft 201 corresponding to the roll diameter of the roll sheet S. In the winding portion, a tension is detected using the tension roller 29 and the torque of the motor (not illustrated) of the winding drive shaft 202 is controlled so as to have a predetermined tension. Each of these tensions is determined according to the roll diameter of the roll sheet S.

When the printer 1 receives printing data from the computer 110, the controller 60 rotates the motor (not illustrated) of the first transport roller 22 at a constant speed. In a state that a tension is given to the roll sheet S as described above, the first transport roller 22 rotates at a constant speed, and thereby the roll sheet S is transported in a transport direction at a constant speed. The roll sheet S during the transport gets in close contact with the support table 26 by an absorption mechanism included in the support table 26. In the embodiment, the position of each head is fixed, so that each head and the roll sheet S move relative to one another in the transport direction by transporting the roll sheet S in the transport direction.

The controller 60 intermittently discharges an ink from the nozzle of each head 31 of the head unit 30 based on image data received from the computer 110 (dot formation operation) while the roll sheet S is transported. A dot is formed on the roll sheet S in this manner.

First, the controller 60 discharges a white ink from the head 31 for a white ink (W) to print a white image for a background (background image).

Next, the controller 60, when the roll sheet S passes under the head 31 for cyan (C), discharges a cyan ink from the head 31 onto a background image to print in cyan. In a similar manner, the controller 60 discharges a magenta ink from the head 31 to print in magenta when the roll sheet S passes under the head 31 for magenta (M), discharges a yellow ink from the head 31 to print in yellow when the roll sheet S passes under the head 31 for a yellow (Y), and discharges a black ink from the head 31 to print in black when the roll sheet S passes under the head 31 for a black (K). In this way, a color image is printed on the white background image.

Ink Supply Unit

The printer 1 in the embodiment includes, as an ink supply unit 70, an ink container holder 72 and an ink supply tube 71 which supplies an ink to the head 31 from the ink container holder 72.

Figure 3A:
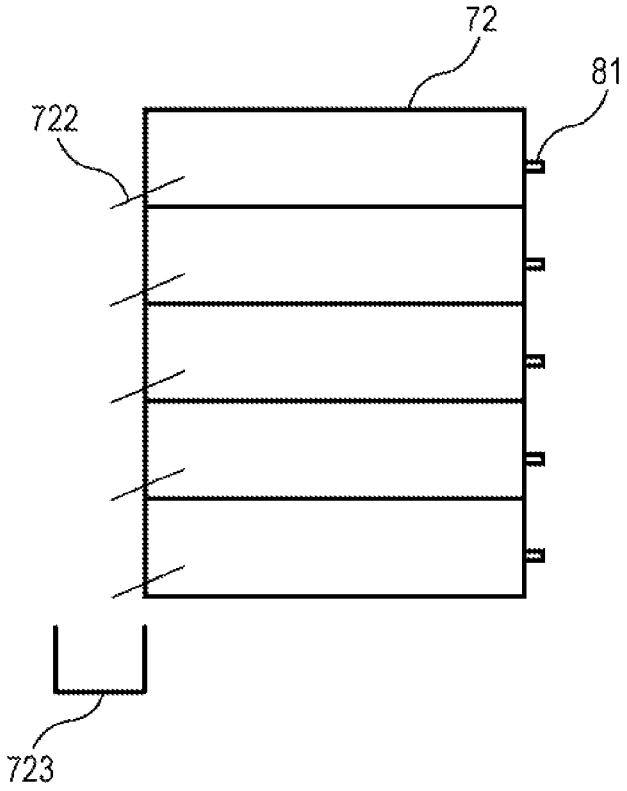
FIGS. 3A and 3B are schematic views each showing the configuration of an ink container holder in the printer of the embodiment.
Figure 3B:
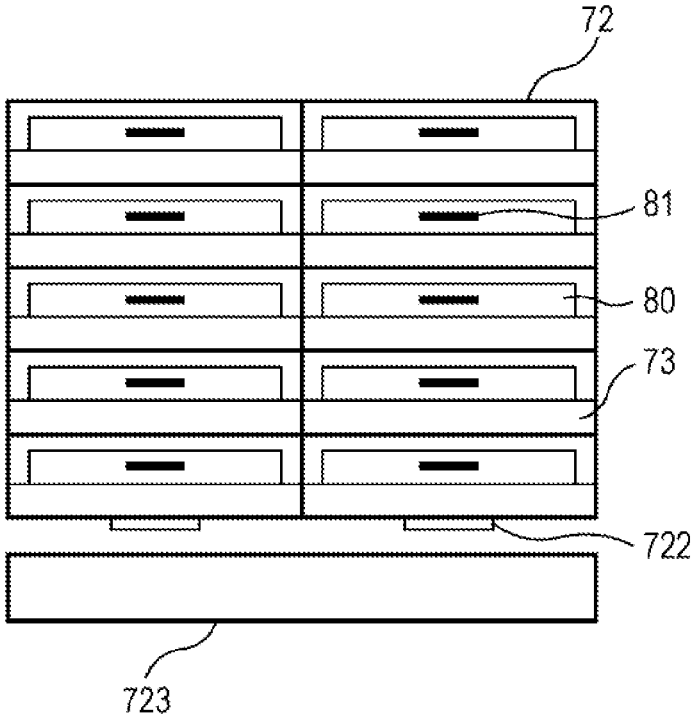
Figure 4:
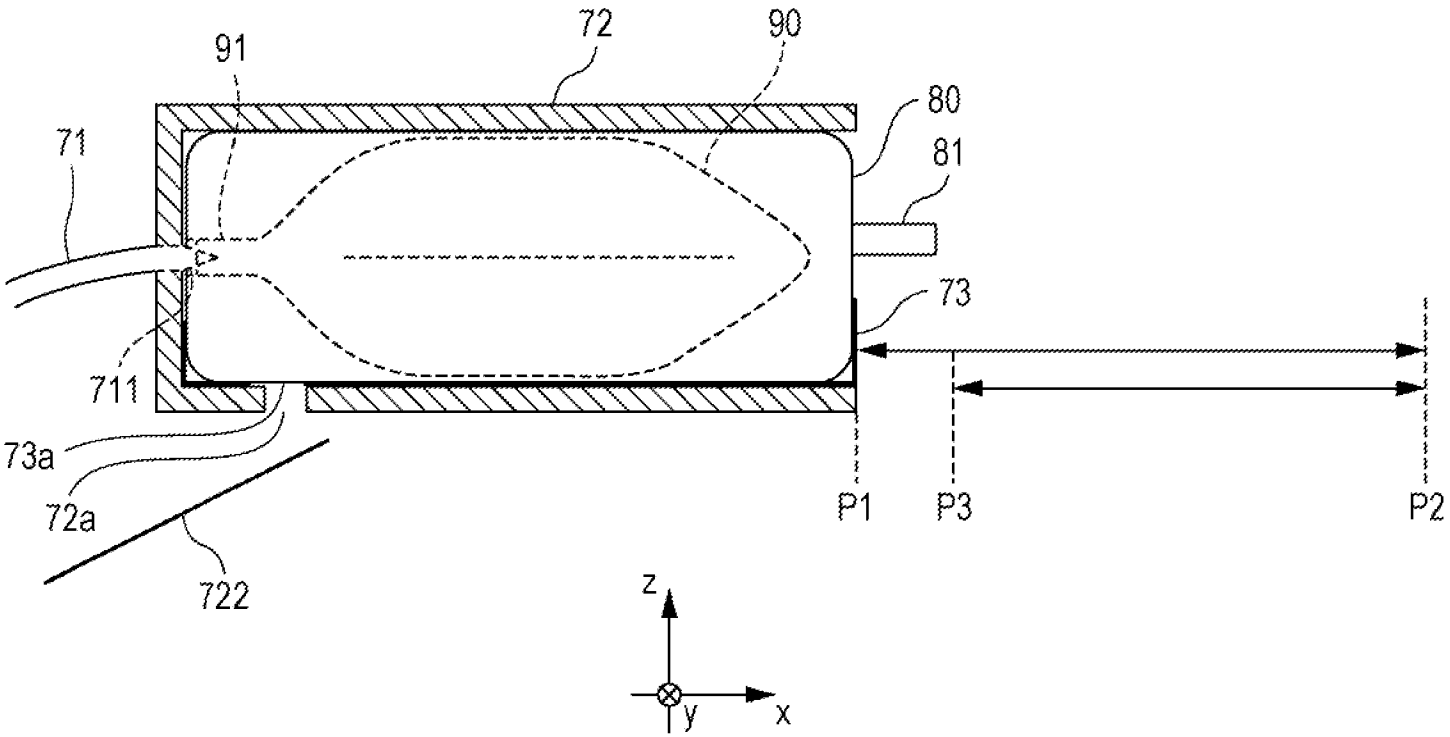
FIG. 4 is a cross-sectional view showing the configuration of the ink container holder corresponding to one color.
Figure 5:
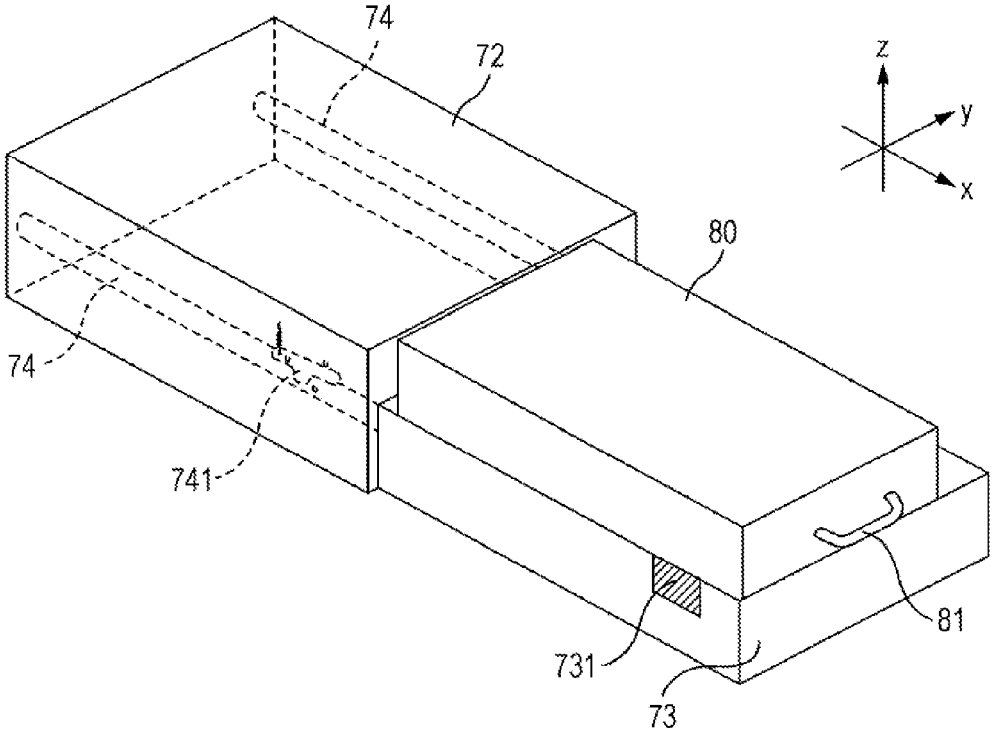
FIG. 5 is a perspective view when pulling out an ink container tray from the ink container holder.
Figure 6:
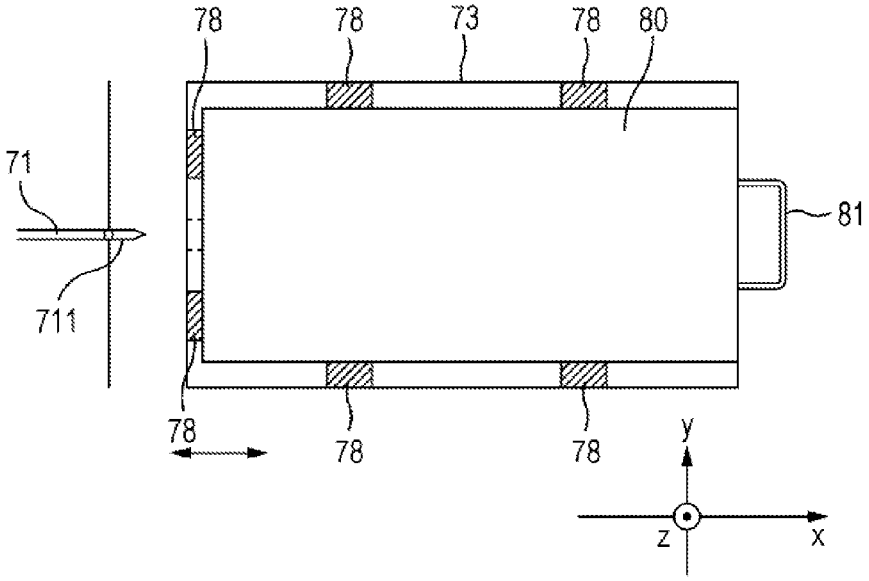
FIG. 6 is a projection view showing the inside of the ink container holder from the top.

FIGS. 3A and 3B are schematic views each showing the configuration of the ink container holder 72 in the printer 1 of the embodiment, and FIG. 3A is a side view and FIG. 3B is a front view. In addition, FIG. 4 is a cross-sectional view showing the configuration of the ink container holder 72 corresponding to one color. FIG. 5 is a perspective view when pulling out the ink container tray 73 from the ink container holder 72. FIG. 6 is a projection view showing the inside of the ink container holder 72 from the top. In the following description, directions shown in the drawings are referred to as an x direction, a y direction, and a z direction, (corresponding to a gravity direction) respectively. Moreover, the front end side of an arrow in each direction is defined as a plus (+) side, and the opposite side is defined as a minus (−) side.

Ink Container Holder 72

The ink container holder 72 in the printer 1 is provided for each ink color. The printer 1 in the embodiment as described above uses inks of five colors. In the embodiment, there are two ink container holders 72 for each color, and these are ten ink container holders 72 disposed in five layers, which are different in color from each other and are superimposed on each other in the z direction (gravity direction) as shown in FIG. 3A, with the ink container holders 72 of the same color being disposed side by side in the y direction (a direction intersecting the gravity direction) as shown in FIG. 3B. Disposition of the ink container holders 72 in this manner makes it easy to shake the inks of the same color with both hands. In the embodiment, these ten ink container holders 72 are integrally formed, but may also be provided to secure to each other those that are individually formed. The configurations of the ink container holders 72 are all the same as each other, so that a description will be given of only one of the ink container holders.

As shown in FIG. 4, the ink container holder 72 has an open surface on a +x direction side, is a member having a rectangular shape (box shape) whose inside is hollow, and accommodates the ink container (the ink case 80 and the ink pack 90 to be described below). An ink supply tube 71 which supplies an ink to the head 31 is connected to the end surface on a −x direction side of the ink container holder 72. In the embodiment, a tube is used for the ink supply tube 71.

The ink container holder 72 includes an ink supply needle 711, an ink container tray 73, and rails 74.

The ink supply needle 711 (corresponding to a connection portion) is for connecting the ink supply tube 71 and the ink supply port 91 of the ink pack 90. An ink supplied to the head 31 is stored in the ink pack 90, and an ink of the ink pack 90 is supplied to the head 31 from the ink supply port 91 through the ink supply needle 711 and the ink supply tube 71.

The rails 74 (corresponding to the guide portion), as shown in FIG. 5, are provided along the x direction so as to guide the ink container tray 73 to be moveable in the x direction on a side surface on a +y direction side and a side surface on a −y direction side of the ink container holder 72, respectively.

The ink container tray 73 is for mounting the ink case 80, and is moveable along the rails 74 (along the x direction) in the ink container holder 72. As shown in FIG. 5, a locking member 741 is provided on the rails 74, and a locking member 731 is provided on the ink container tray 73. The locking member 741 and the locking member 731 will be described in detail later.

In addition, as shown in FIG. 4, an opening 73*a* is formed at the bottom portion of the ink container tray 73, and an opening 72*a* is formed at a portion right under the opening 73*a* when the ink container holder 72 accommodates the ink container tray 73. The opening 73*a* of the ink container tray 73 and the opening 72*a* of the ink container holder 72 are for discharging a leaked ink in the ink container holder 72.

In addition, the ink container holder 72 is provided with the ink guide plate 722, and the ink guide plate 722 is provided so that a position of a leading edge (+x direction edge) is at least further on the +side in the x direction than the leading edge of the ink supply needle 711. In addition, the position of the leading edge is further on the +side in the x direction than the opening 72*a* and the opening 73*a* when accommodating the ink container tray 73 in the ink container holder 72.

Accordingly, a leaked ink from the ink case 80 (ink pack 90) or a leaked ink from the ink supply needle 711 falls to the ink guide plate 722 through the opening 73*a* of the ink container tray 73 and the opening 72*a* and is guided by the ink guide plate 722 to flow down to the ink receiving portion 723 (refer to FIG. 3). In addition, a sensor (for example, a weight sensor) which is not illustrated is provided in the ink receiving portion 723, and it is possible to determine whether or not there is an ink leakage using the sensor.

In addition, the ink container tray 73, as shown in FIG. 6, has fixing members 78 which fix a position of the ink case 80. The fixing members 78 are provided, two on each of the following: the side surface on +y direction side, the side surface on −y direction side, and the side surface on −x direction side in the ink container tray 73. By providing the fixing members 78, when performing a shake, it is possible to reliably fix the ink case 80 in the ink container tray 73.

Ink Pack 90

Figure 7:
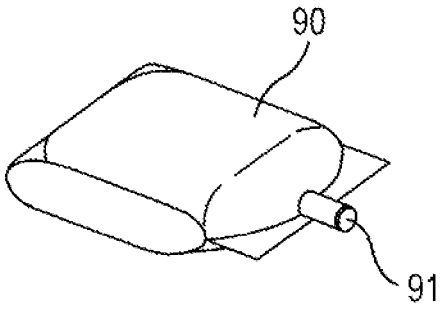
FIG. 7 is a view for describing an ink pack.

FIG. 7 is a view for describing an example of the ink pack 90.

As described above, an ink is stored in the ink pack 90. The printer 1 of the embodiment is a large printer, and the ink capacity of the ink pack 90 is about three liters. The ink pack 90 has an ink supply port 91 as shown in FIG. 7.

The ink supply port 91 is a supply port for supplying the ink in the ink pack 90 to the outside. In the embodiment, the ink supply needle 711 of the ink container holder 72 is delivered to the ink supply port 91, and thereby an ink is supplied to the head 31.

Ink Case 80

Figure 8:
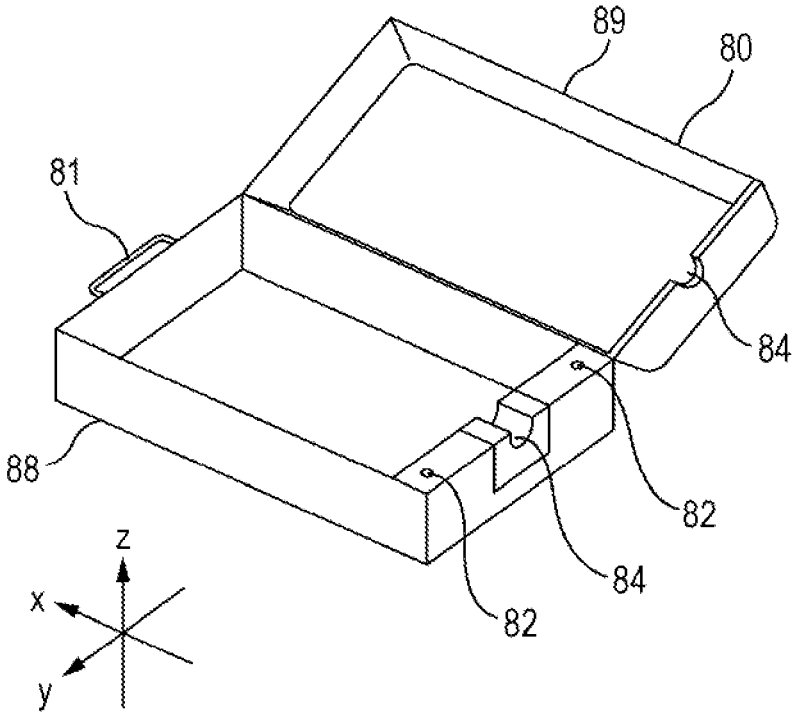
FIG. 8 is a view for describing an ink case.

FIG. 8 is a view for describing an example of the ink case 80. In the embodiment, the ink pack 90 and/or the ink case 80 corresponds to an ink container.

The ink case 80 is a case which accommodates the ink pack 90. As shown in FIG. 8, the ink case 80 is provided to be openable and closable, and is made to be able to replace the ink pack 90 therein. Moreover, the ink case 80 has a handle 81, a cut-out portion 84, a hole 82, a first case member 88, a second case member 89, and an ink pack fixing member 85 (see FIG. 10B).

The first case member 88 and the second case member 89 are superimposed on each other, thereby forming a closed space in which the ink pack 90 is accommodated (a state where the ink case 80 is closed), and by releasing the superimposed state, it is possible to access the closed space in which the ink pack 90 is accommodated (a state where the ink case 80 is open). In the embodiment, side surfaces corresponding to each other of the first case member 88 and the second case member 89 are engaged with each other by an engagement member not illustrated, and the first case member 88 and the second case member 89 are configured to be openable and closable with the engagement member as a pivot. The opening and closing structure of the first case member 88 and the second case member 89 can take various aspects.

Figure 9:
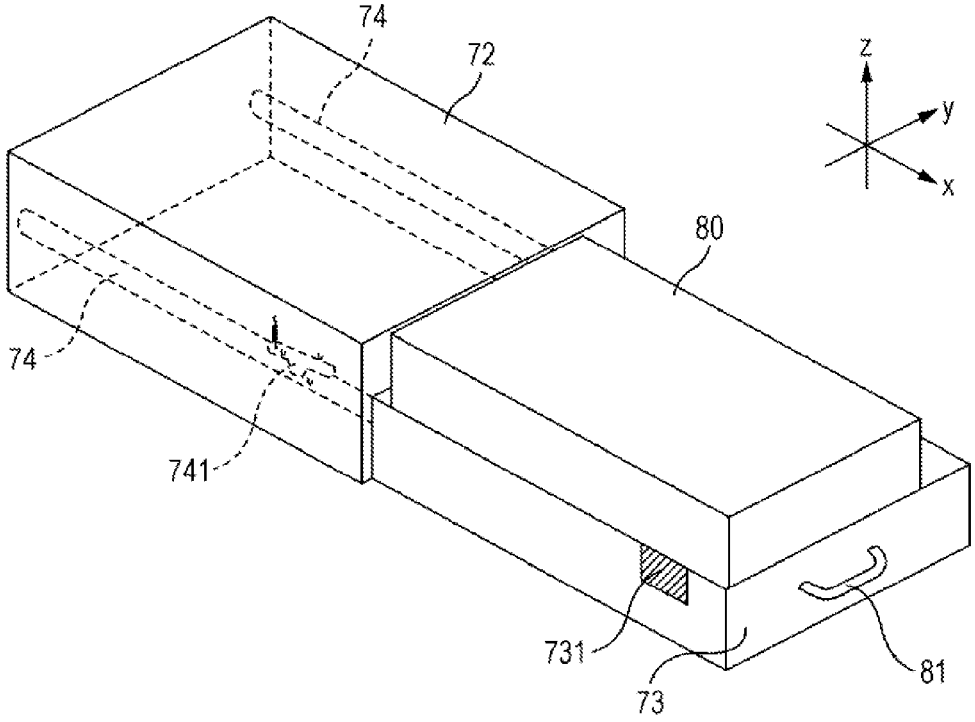
FIG. 9 is a view for describing the ink container tray when providing a handle to the ink container tray.

The handle 81 is provided on the end surface on the +x direction side of the ink case 80. The handle 81 is a portion that a user grips when pulling out the ink case 80 from the ink container holder 72 or pushing the ink case 80 back. In the ink case 80, a side surface where the handle 81 is provided corresponds to a first side surface, a portion of the first case member 88 on the first side surface corresponds to a second side surface, and a portion of the second case member 89 on the first side surface corresponds to a third side surface. Providing the handle 81 can easily move the ink container tray 73. In addition, it is preferable that the handle 81 be provided on the first case member 88 (that is, the second side surface). In this case, the ink container tray 73 can be more stably moved. The handle 81 may be provided not in the ink case 80, but in the ink container tray 73 as shown in FIG. 9. Even in this case, it is possible to easily move the ink container tray 73 in a similar manner. The cut-out portion 84 is of a semi-circular shape in a state where the ink case 80 is open, and is provided in each of the first case member 88 and the second case member 89, so as to be of a circular shape in a state where the ink case 80 is closed. The cut-out portion 84 supports the ink supply port 91 of the ink pack 90 when the ink case 80 is closed, and exposes the ink supply port 91 to the outside to allow the ink supply port 91 and the ink supply needle 711 of the ink container holder 72 to be connected to each other. In the ink case 80, a side surface where the cut-out portion 84 is provided corresponds to a fourth side surface, a portion of the first case member 88 on the fourth side surface corresponds to a fifth side surface, and a portion of the second case member 89 on the fourth side surface corresponds to a sixth side surface. In the embodiment, the cut-out portion 84 is provided in each of the first case member 88 and the second case member 89; however, the invention is not limited thereto. For example, the cut-out portion which can expose the ink supply port 91 of the ink pack 90 may be provided in one of the first case member 88 and the second case member 89.

The ink pack fixing member 85 is for fixing the ink pack 90 to the ink case 80.

A hole 82 is a hole for screwing the ink pack fixing member 85 into the ink case 80.

Figure 10A:
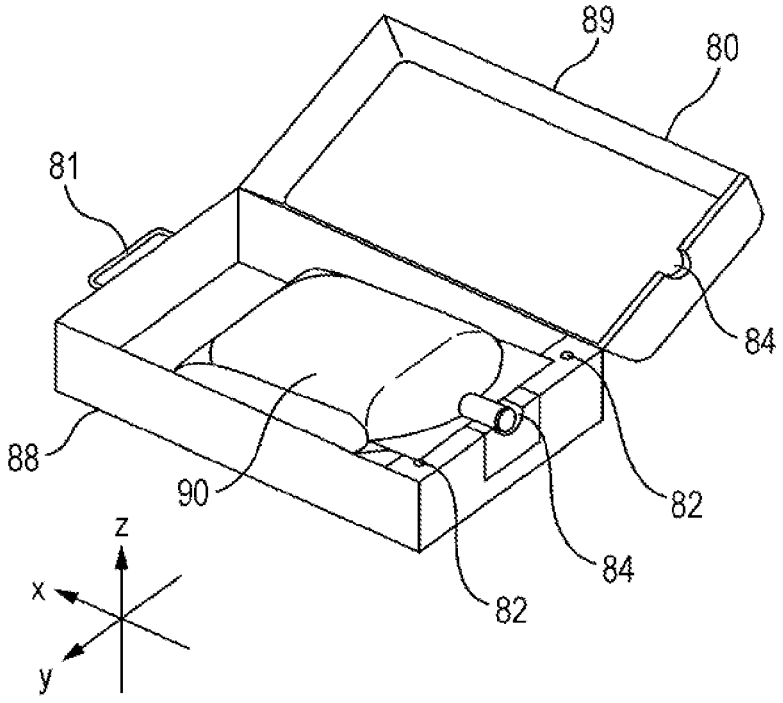
FIGS. 10A and 10B are views for describing the ink case when loading the ink case with the ink pack.
Figure 10B:
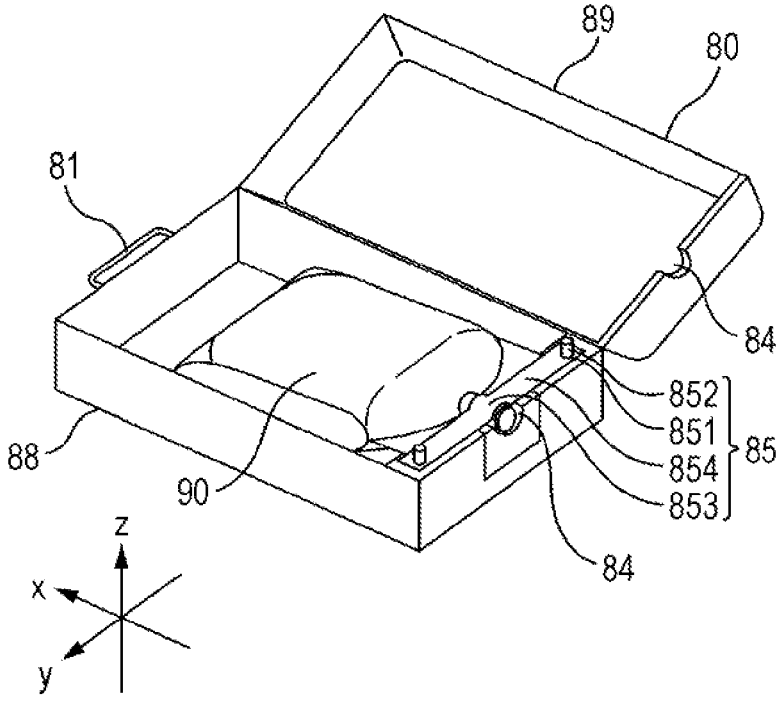

FIGS. 10A and 10B are views for describing the ink case when loading the ink pack 90 onto the ink case 80. When loading the ink pack 90 onto the ink case 80, as shown in FIG. 10A, the ink pack 90 is loaded onto the ink case 80 so that the ink supply port 91 is positioned on the cut-out portion 84, and furthermore, a fixing screw 852 is inserted into a hole 851 of the ink pack fixing member 85 and a hole 82 of the ink case, 80 as shown in FIG. 10B. The ink pack 90 is fixedly positioned in the ink case 80 by using the ink pack fixing member 85 in this manner. At this time, an end portion of the ink pack 90 is pinched by a plate-shape portion 854 of the ink pack fixing member 85, and thereby the ink pack 90 is firmly fixed to the ink case 80. In addition, the ink pack fixing member 85 has a recess portion 853 recessed to fit the ink supply port 91 at the center portion thereof, and the ink supply port 91 is fixedly positioned between the cut-out portion 84 and the recess portion 853. In this state, the ink case 80 is closed. Accordingly, the ink supply port 91 is exposed to the outside, and the ink pack 90 is accommodated into the ink case 80 in a state of being fixed.

Connection between Ink Container Holder 72 and Ink Case 80

Figure 11A:
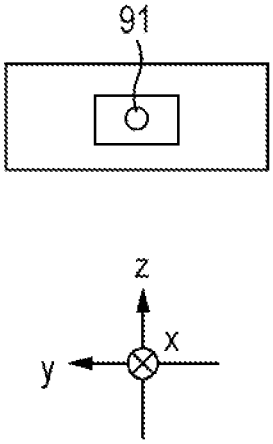
FIG. 11A is a schematic view showing a connection portion on the ink case side.
Figure 11B:
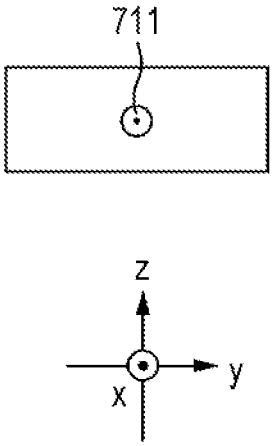
FIG. 11B is a schematic view showing the connection portion on the ink container holder side.

FIG. 11A is a schematic view showing the connection portion on the ink case 80 side, and FIG. 11B is a schematic view showing the connection portion on the ink container holder 72 side.

When pushing the ink case 80 (causing the ink case to move in the −x direction) in a state as shown in FIG. 6, it is possible to insert (connect) the ink supply needle 711 into the ink supply port 91 of the ink pack 90.

Agitating of Ink

In the case of a settled ink (for example, white ink), in order to bring the concentration of the ink in the ink pack 90 into uniformity, it is necessary to shake the ink pack 90 multiple times everyday. As described above, the capacity of the ink pack 90 in the embodiment is three liters, and there is a heavy load in the user's shaking the ink pack 90 alone in the absence of the present invention. In addition, there is a possibility of dropping the ink pack 90 by mistake while removing the ink pack 90 from the printer 1.

Therefore, in the printer 1 of the embodiment, the rails 74 are provided in the ink container holder 72 so that the ink pack 90 can be agitated in the device. More specifically, by providing the rails 74, the ink container tray 73, the ink case 80, and the ink pack 90 mounted in the ink case 80 are enabled to move in the x direction between a position P1 and a position P2 (refer to FIG. 4). Accordingly, the ink pack 90 can be easily shaken in the device, and the ink can be simply and easily agitated. The position P1 of FIG. 4 is a position where the ink supply tube 71 and the ink pack 90 are connected to each other by the ink supply needle 711 of the ink container holder 72 (corresponding to an ink supply position). In addition, the position P2 is a position when mounting the ink case 80 onto the ink container tray 73 (corresponding to an ink container mounting position). At this time, it is preferable that the ink container tray 73, the ink case 80, and the ink pack 90 be disposed with respect to the ink container holder 72 so as to match the longitudinal direction of the ink pack 90 to the moving direction of the ink container tray 73 (the extending direction of the rails 74 (x direction)). When having such a disposition, it is possible to increase the agitating amount of the ink in the ink pack 90 and to reduce the number of shakes necessary for bringing the ink concentration into uniformity. In addition, the handle 81 is preferably provided so as to protrude in a direction (+x direction side) towards the ink container mounting position (P2) from the ink supply position (P1) with the ink case 80 mounted in the ink container holder 72. Furthermore, in a top view (when viewed from +z direction), the handle 81 is preferably provided so as to straddle the cut-out portion 84, the ink supply port 91, and the ink supply needle 711 in a y direction. In this way, with the ink case 80 mounted in the ink container tray 73, it is easy to shake the ink case 80 by moving the ink container 73 back and forth along the rails 74 and the force of the arm during the shake can be easily delivered to the ink container tray 73.

However, when performing the shake in the device, there is a possibility that the ink supply needle 711 is removed from and inserted to the ink supply port 91 of the ink pack 90 many times. Accordingly, the ink supply needle 711 is possibly damaged.

Therefore, in the printer 1 of the embodiment, a locking mechanism is provided to the rails 74 and the ink container tray 73, and when the ink container tray 73 is pulled out to a certain extent (from the position P1 to a position P3 in FIG. 4), locking is applied, so that it is not possible to move the ink container tray 73 in a pushing direction (further to the −x direction side than the position P3). Accordingly, it is possible to prevent the damage of the device and to perform agitating between the position P3 and the position P2 in an easy and safe manner.

Locking Mechanism

Figure 12A:
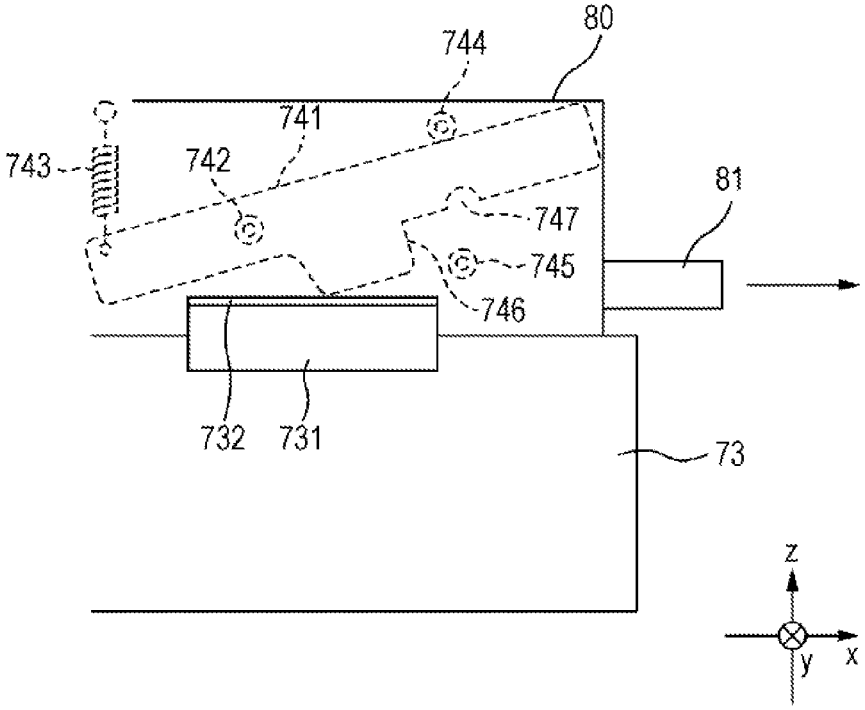
FIGS. 12A and 12B are views for describing a locking mechanism.
Figure 12B:
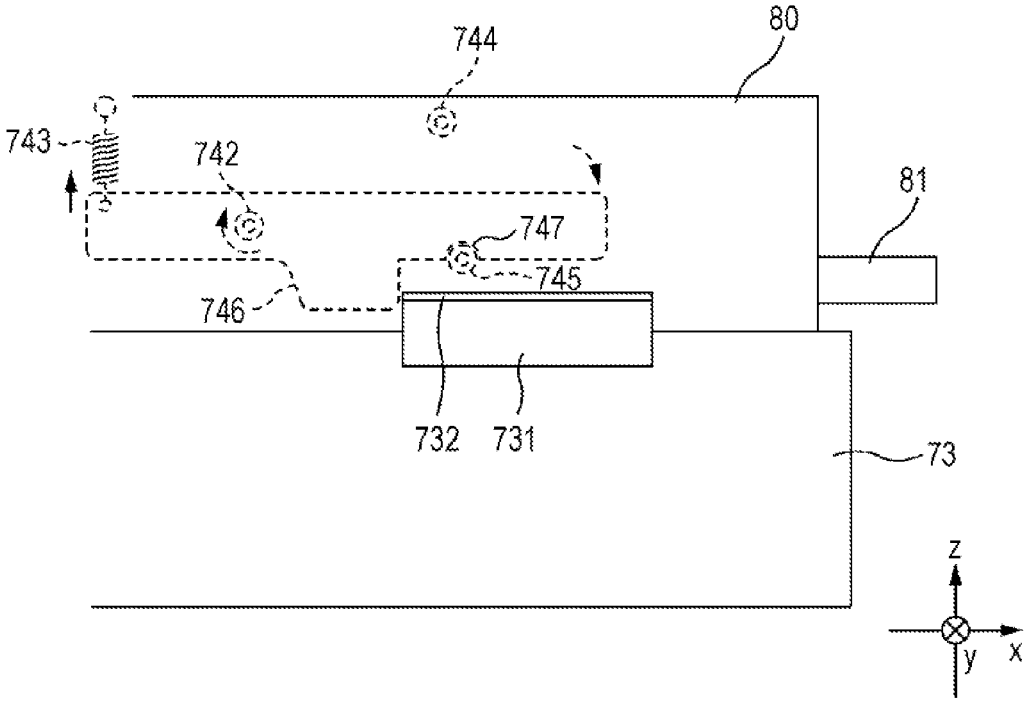

FIGS. 12A and 12B are views for describing a locking mechanism. FIG. 12A is a view for describing a state in which the locking is not applied, and FIG. 12B is a view for describing a state in which the locking is applied. The dotted line in these drawings shows the configuration of the ink container holder 72 side, and the solid line shows the configuration of the ink container tray 73 and the ink case 80 side.

The locking mechanism in the embodiment is configured to have a locking member 741 provided at the rails 74 of the ink container holder 72 and a locking member 731 provided at the ink container tray 73.

The locking member 741 (corresponding to a first locking member) is an elongated plate-shaped member, and rotatably provided about a shaft 742 in the rails 74 of the ink container holder 72. In addition, the locking member 741 has a protrusion portion 746 further at the lower portion on +x direction side (−z direction side end) than the shaft 742, and has a recess portion 747 of a semi-circular shape further at the lower portion on +x direction side than the protrusion portion 746. In addition, one end of a spring 743 whose other end is fixed to the ink container holder 72 is connected to the end portion on a −x direction side of the locking member 741. In addition, a protrusion 744 and a protrusion 745 for limiting the movement (rotation) range of the locking member 741 are provided in the ink container holder 72, and the locking member 741 is rotatable about the shaft 742 in a range between the protrusion 744 and the protrusion 745.

The locking member 731 (corresponding to a second locking member) is attached to the upper end portion of the side surface on a −y direction side of the ink container tray 73. The locking member 731 in the embodiment is a plate-shaped member, and has a bent portion 732 which is bent in a −y direction on the upper end (+z direction side end). Therefore, a cross-sectional surface perpendicular to the x axis has an L-shape.

In the above configuration, for example, when the ink container tray 73 is at the position P1 of FIG. 4, the configuration is as shown in FIG. 12A. That is, the protrusion portion 746 of the locking member 741 is in contact with the upper surface of the bent portion 732 of the locking member 731. Since the spring 743 is extended at this time, the force in a contracting direction is exerted, so that the end portion of the locking member 741 in a −x direction side is biased upwards (+z direction). Therefore, the locking member 741 is to rotate about the shaft 742, but cannot rotate since the protrusion portion 746 and the upper surface of the bent portion 732 of the locking member 731 are in contact with each other. In this state, when moving the ink container tray 73 (ink case 80) in an x direction, with the protrusion portion 746 and the bent portion 732 being in contact with each other, the locking member 731 slides in the x direction. That is, it is possible to move the ink container tray 73 to both a +x direction side and a −x direction side.

When the ink container tray 73 (ink case 80) is at the position P3 of FIG. 4, as shown in FIG. 12B, the protrusion portion 746 deviates from the bent portion 732. Accordingly, the spring 743 is contracted, and the locking member 741 rotates about the shaft 742 until the recess portion 747 and the protrusion portion 745 are in contact with each other. In the state of FIG. 12B, it is possible to move the ink container tray 73 (ink case 80) in a pull-out direction (+x direction). However, the +x direction side end of the protrusion portion 746 and the side portion (the end on −x direction side) of the bent portion 732 are in contact with each other at the portion P3 in a pushing direction (−x direction). That is, it is not possible to move (push) the ink container tray 73 further to the −x direction side than the position P3.

In this manner, when pulling out the ink container tray 73 (ink case 80) from the position P1, locking is applied at the position P3, it is again not possible to move the ink container tray 73 further to the −x direction side than the position P3. Therefore, a movement range after the locking is applied is from the position P2 of FIG. 4 to the position P3, and it is possible to reliably prevent the damage of the ink supply needle 711 and the like by performing a shake in the range.

After the locking is applied, when pushing the ink container tray 73 further to the −x direction side than the position P3 again, a user lifts the end portion on the +x direction side of the locking member 731 to a +z direction side (upper side) to push the ink container tray 73 (ink case 80). Accordingly, it is possible to move the ink container tray 73 to the position P1 again. The configuration of the locking mechanism is not limited to this example, and other configurations may be applied.

As described above, the printer 1 in the embodiment includes an ink container holder 72 which accommodates the ink case 80 (and the ink pack 90). Then, the ink container holder 72 has the ink container tray 73 which can hold the ink case 80, the ink supply needle 711 which is for connecting the ink supply port 91 of the ink pack 90 and the ink supply tube 71, and the rails 74 which guide the ink container tray 73 so as to be moveable between the position P1 and the position P2.

Accordingly, it is possible to agitate the ink in the ink pack 90 without removing the ink case 80 (ink pack 90) from the ink container holder 72. Moreover, since agitating can be performed only by grasping the handle 81 of the ink case 80 and causing the handle to reciprocate (vibration) in an x direction, it is possible to agitate the ink in an easy and safe manner.

Other Embodiments

The printer and the like are described as an embodiment, and the above-mentioned embodiments merely facilitate the understanding of the invention, but are not intended to be interpreted as limiting the invention. The invention can be modified and improved without departing from the scope thereof. In particular, the non-limiting embodiments described below are included in the invention.

Printer

A printer is not limited to the above-described embodiment.

For example, the printer may a printer (a so-called serial printer) which forms an image by alternately repeating a dot forming operation which forms a dot row along a moving direction while moving the head unit in the movement direction intersecting the nozzle row direction and a transport operation (movement operation) which transports a medium in a transport direction which is a nozzle row direction.

In addition, in the embodiment, the computer 110 is configured as an external device, but the printer 1 may be configured to have the computer 110.

Method of Discharging

In the above-mentioned embodiment, an ink is discharged using a piezoelectric element (piezo element). However, a method of discharging a liquid is not limited thereto. Other methods such as a method of generating bubbles in the nozzle using heat and the like may be used.

Medium

In the above-mentioned embodiment, a medium is described by taking the roll sheet S as an example, but is not limited thereto. For example, the medium may be a cut paper, a film, or a fabric.

Ink

The printer 1 in the above-mentioned embodiment uses color inks of four colors of cyan, magenta, yellow, and black as inks for a color image, but may further use inks of other colors (for example, light cyan, light magenta, and the like).

Ink Container

In the above-mentioned embodiment, the ink pack 90 is inserted in the ink case 80, and the ink case 80 is accommodated in the ink container holder 72. However, the invention is not limited thereto. For example, the ink pack may be configured to be accommodated in the ink container holder 72 as it is. At that time, it is preferable that the ink pack 90 and the ink supply port 91 be configured to be fixedly positioned in the ink container tray 73. In this case, the ink pack corresponds to the ink container. In addition, the ink container holder 72, ink container tray 73 etc. may be provided for a single ink, for example where agitation of only that ink is necessary/desirable.

The entire disclosure of Japanese Patent Application No. 2013-065771, filed Mar. 27, 2013 is expressly incorporated by reference herein.

What is claimed is:

1. A printing apparatus comprising:

an ink container tray which is capable of holding an ink container;

a guide portion for guiding the ink container tray in a movable manner between an ink container mounting position when mounting the ink container onto the ink container tray and an ink supply position; and a locking mechanism which, when the ink container tray is positioned further to the ink container mounting position side than at a predetermined position that is between the ink supply position and the ink container mounting position, stops the ink container tray from moving further to the ink supply position side than the predetermined position and allows the ink container tray to move between the predetermined position and the ink container mounting position, while the locking mechanism is applied.

2. The printing apparatus according to claim 1, wherein the locking mechanism includes:

a first locking member which is provided at the guide portion; and a second locking member which is provided at the ink container tray, wherein the first locking member, when the ink container tray is between the ink supply position and the predetermined position, allows the second locking member of the ink container tray to move to the ink supply position side and the ink container mounting position side, and when the ink container tray is further to the ink container mounting position side than the predetermined position, stops the second locking member of the ink container tray from moving to the ink supply position side.

3. The printing apparatus according to claim 1, further comprising:

an ink supply tube; and a connection portion for connecting the ink supply tube and an ink supply port of an ink pack, wherein, when the ink container in which the ink pack is disposed is positioned at the ink supply position, the ink supply tube and the ink supply port are connected to each other through the connection portion.

4. The printing apparatus according to claim 3, wherein the ink container tray is guided by the guide portion so as to have the longitudinal direction of the ink container tray and the extending direction of the guide portion matched with each other, and the ink pack is disposed in the ink container so as to have the longitudinal direction of the ink pack and the longitudinal direction of the ink container matched with each other.

5. The printing apparatus according to claim 1, wherein the ink container tray has a handle, and the handle protrudes in a direction in which the ink container tray moves to the ink container mounting position side from the ink supply position side.

6. The printing apparatus according to claim 1, wherein the ink container tray has a discharge mechanism for discharging an ink leaked from the ink container or the connection portion.

7. The printing apparatus according to claim 1, further comprising:

a first ink container holder, a second ink container holder, and a third ink container holder which each include a respective said ink container tray, guide portion, and locking mechanism, wherein the first ink container holder and the second ink container holder are disposed side by side in a gravity direction, and the first ink container holder and the third ink container holder are disposed side by side in a direction intersecting the gravity direction, and the inks held in the first ink container holder and the second ink container holder are different in color, and the inks held in the first ink container holder and the third ink container holder are the same in color.

* * * * *